US007497168B2

(12) United States Patent
Andreasen

(10) Patent No.: US 7,497,168 B2
(45) Date of Patent: Mar. 3, 2009

(54) MODULAR UNIT TRANSPORTATION SYSTEM METHOD AND APPARATUS

(76) Inventor: Howard Andreasen, 2696 Willeys Lake Rd., Custer, WA (US) 98240

( * ) Notice: Subject to any disclaimer, the term of this patent is extended or adjusted under 35 U.S.C. 154(b) by 196 days.

(21) Appl. No.: 11/423,944

(22) Filed: Jun. 13, 2006

(65) Prior Publication Data

US 2007/0131133 A1 Jun. 14, 2007

Related U.S. Application Data

(60) Provisional application No. 60/690,555, filed on Jun. 13, 2005.

(51) Int. Cl.
*B61B 3/00* (2006.01)
*B61B 12/04* (2006.01)

(52) U.S. Cl. ..... 104/122; 104/123; 104/89

(58) Field of Classification Search ..... 104/89, 104/122–124, 307

See application file for complete search history.

(56) References Cited

U.S. PATENT DOCUMENTS 611,145 A 9/1898 Pollock
3,552,321 A 1/1971 Priebe
3,734,025 A 5/1973 Shoemaker
3,769,913 A 11/1973 McRar et al.
3,848,533 A 11/1974 Grow
3,865,041 A 2/1975 Bacon
3,880,084 A 4/1975 Denenburg
3,910,196 A 10/1975 Denenburg
3,939,775 A 2/1976 Barry
3,987,734 A 10/1976 Horn
4,057,017 A 11/1977 Michalon
4,082,042 A * 4/1978 Barry ..... 104/18
4,425,851 A * 1/1984 Long ..... 104/20
2007/0028797 A1* 2/2007 Poole ..... 104/307
2007/0131133 A1* 6/2007 Andreasen ..... 104/89

* cited by examiner

*Primary Examiner*—S. Joseph Morano
*Assistant Examiner*—Jason C Smith
(74) *Attorney, Agent, or Firm*—Michael F. Hughes; Hughes Law Firm, PLLC

(57) ABSTRACT

A module transportation system where modules are transported from a movable carrier frame to a carriage such as a flatbed portion of a train while in motion. The system comprises a support structure and a carrier frame adapted to be attached thereto. The carrier frame can transfer modules to and from the moving train.

7 Claims, 11 Drawing Sheets

MODULAR UNIT TRANSPORTATION SYSTEM METHOD AND APPARATUS

This application claims priority of U.S. Ser. No. 60/690,555, filed Jun. 13, 2005.

BACKGROUND OF THE INVENTION

In general various methods of transportation systems have been disclosed in the prior art. However, the complex nature of the prior art lends itself to very difficult systems to employ.

The prior art reference U.S. Pat. No. 4,425,851 (Long) shows a monorail module that is loaded with passengers, brought up to the speed of a non-stop train, and attached to the train by magnetic means. The passengers enter or exit the non-stop train by a stairway. U.S. Pat. Nos. 4,082,042 and 3,939,775 (Barry) show a transfer system in which containers, such as passenger container 16, are loaded at a fixed point and transferred by an overhead rail means to a non-stop moving vehicle. The transfer container's speed is controlled so that it can be lowered into a cavity in the moving vehicle.

Other references such as U.S. Pat. No. 4,057,017 (Michalon) shows a transport system in which there is a main non-stop conveyor like loop and a series of stations along the main conveyor. Each station includes a conveyor that accelerates the loaded passenger cabin to the speed of the main, non-stop conveyor loop and transfers the cabin to it. The reference U.S. Pat. No. 3,987,734 (Horn) shows a transport system in which there is a conveyor moving at a constant speed. There are a series of stations along the constant speed conveyor that accelerate loaded passenger modules to the speed of the main conveyor, and then transfer the modules to it. FIG. 1 shows a perspective view of the system in operation.

U.S. Pat. No. 3,910,196 (Denenburg) shows a bus like vehicle that carries a transfer module. As seen in FIG. 1, the transfer module is removed from the bus top to the station rail system and the passengers disembark when it has stopped. There is a second, loaded module that the bus picks up as bus passes under the module. Non-stop rail cars such as that as shown in U.S. Pat. No. 3,880,084 (Denenburg) cooperates with a transfer car that is secured to it as it travels between stations. At the station, a transfer car is accelerated along a track until it reaches the speed of the non-stop car and the transfer car is then secured to its roof. The passengers than can move from one to the other.

U.S. Pat. No. 3,865,041 (Bacon) shows a system for loading passenger carriers 19, which may be small boats or cars. The passenger crosses bridge 15, to fixed platform 13, and moves to rotating platform section 11, to which the carriers are secured. The carriers 19, move relative to platform section 11.

U.S. Pat. No. 3,848,533 (Grow) shows a transportation system that involves a nonstop transport route in which there is a long non-stop track that has side tracks at each station. Each car on the line can be channeled off a side track 13 to a specific destination. Cars can also start from the side track and join the non-stop train.

U.S. Pat. No. 3,769,913 (McRar et al) shows a loop transportation system in which there are sidings at each station. Cars are dispatched to various destinations from the stations. The stations are equipped with means to stop and accelerate cars to the main loop.

U.S. Pat. No. 3,734,025 (Shoemaker) shows a non-stop transport system in which loading/unloading vehicles are run parallel to the non-stop vehicles so that cargo or passengers can be moved from one to the other without stopping. U.S. Pat. No. 3,552,321 (Priebe) shows an inter-community transport system in which vehicles are moved from a local to a main loop and back to another local loop. U.S. Pat. No. 611,145 (Pollock) shows a moving station in the form of a rail car that is on a track parallel to the main line. The nonstop train grabs the station and they roll together as freight and passengers move from one to the other.

The prior art devices such as that as shown in U.S. Pat. No. 4,082,042 disclose mechanisms for transporting modules of sorts. This reference, in addition to U.S. Pat. No. 3,393,775 generally has mechanical types of lifting devices to transport the module on and off the train system. Such mechanical devices are always more apt for error in general wear which could cause expense as well as potential for malfunction.

It should be noted that in U.S. Pat. No. 4,820,042 there appears to be a system in FIG. 23 where the lowering of the modules is done by a fourbar-type linkage which is attached to the train sector. It should be noted that the embodiment here allows for the lowering to be done by the carriage which is moveably attached to the base frame member which lowers and raises and accelerates the overhead base frame.

It should be noted that the basic steps for engaging the invention essentially have a very straightforward design where the risk of failure is minimized by its inherent simplicity. In general, there are four phases of dipping, locking, releasing, and lifting to transfer the containers to and from the moving train sections. The dipping allows for the carriage to drop vertically downwardly when positioned above the train section. The locking secures a positive lock where the module is locked to the train section; a release stage then occurs where the module is released from the moving carriage. Finally, a lifting phase occurs where the carriage departs away and is not in the field of travel of the train. If the module is being released, the release and locking steps are reversed and the lifting mechanism carries away from the module from the train section.

In one form, there is inherent allowance for movement and intolerance of the system whereby if an interior frustoconical surface is employed in the locking mechanism which interfaces with a pin of some sort so there is an automatic centering system of the module as it interfaces with the train section when being placed thereon.

SUMMARY OF THE DISCLOSURE

The disclosure recites a module transportation system adapted to operate in a rail system having train tracks. The module transportation system comprises a support system having a support rail supported by vertical members where the support system comprises first and second acceleration and loading zones and an exchange where the vertical members are closer engaged to the train tracks at the exchange than at either of the first or second acceleration zones. The system further has a carrier frame movably attached to the support system and having a module connection portion. The components comprise a connection system having a first position and a second position. A carriage is provided such as a flat bed rail car having a module connection portion that is adapted to connect to the module. Finally there is a module having a carriage connection portion and the module is adapted to be positioned on a carriage in a transportation mode and is further adapted and positioned on the carrier frame in a transition mode.

The connection system is adapt to be positioned in the first position where the carriage connection portion engages the module connection portion of the carriage to fixedly attach thereto and the connection system is adapted to the orientated in the second position where the carrier connection portion of the module is fixedly attached to the module connection member of the carrier frame. The carrier frame is adapted to move on the support system at a proximate velocity of the carriage to either engage and offload the module or to unload the module from the carrier frame to the carriage where the carriage does not need to substantially alter its travel velocity.

DETAILED DESCRIPTION OF THE PREFERRED EMBODIMENTS

Figure 1:
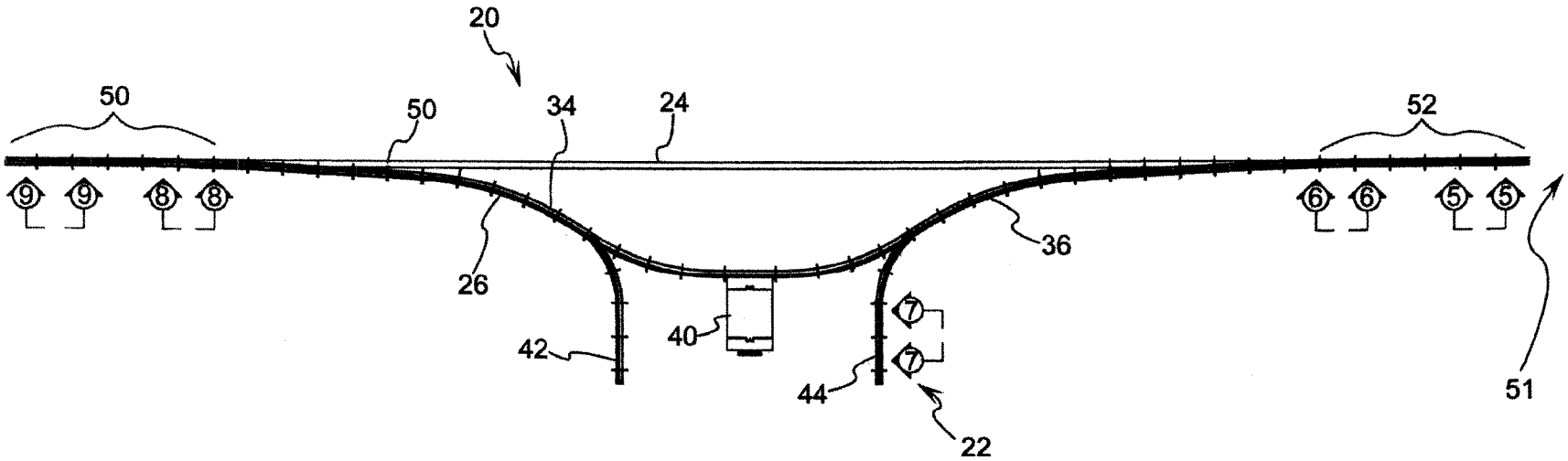
FIG. 1 shows a top view of a module transportation system.
Figure 2:
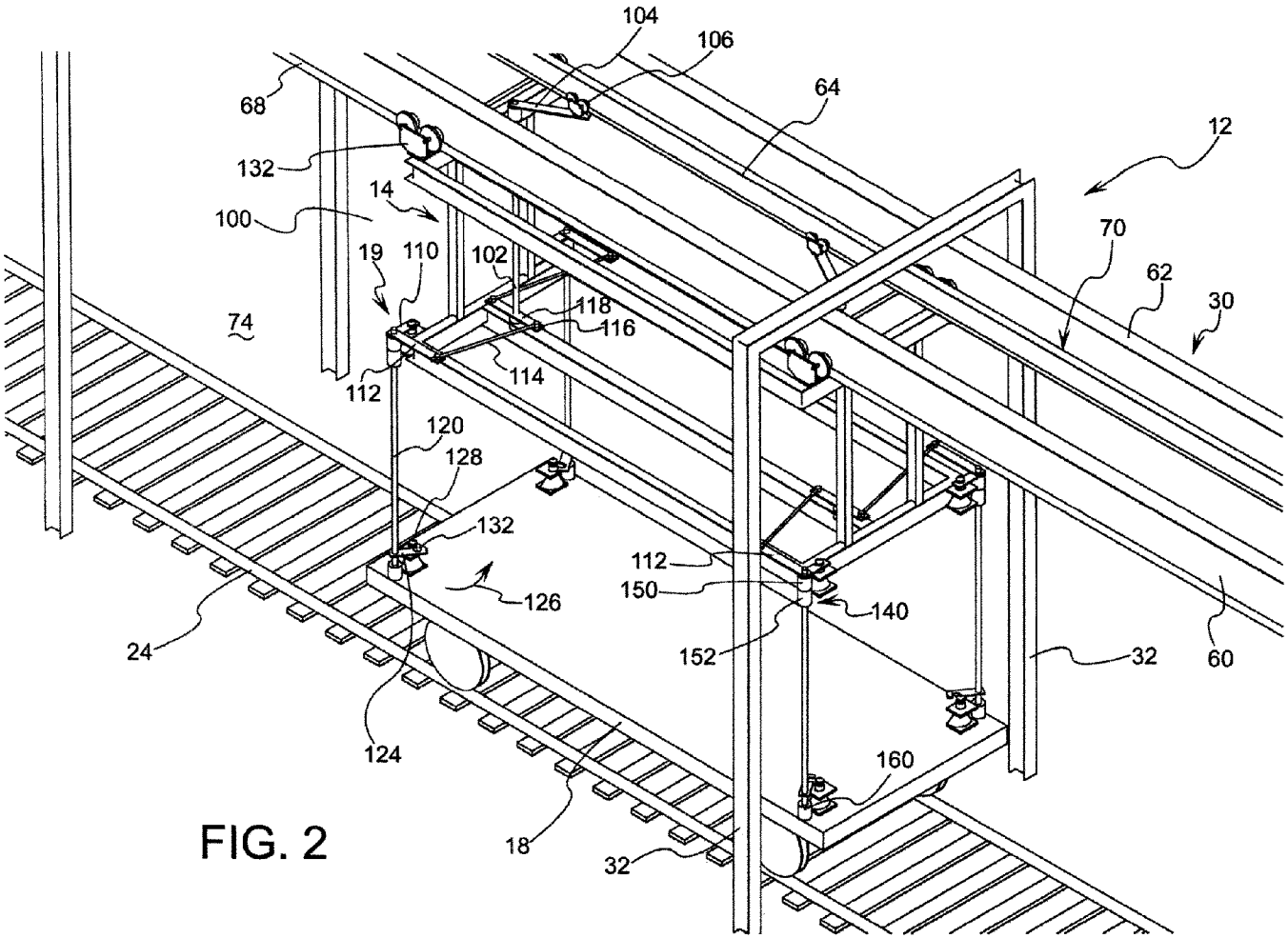
FIG. 2 shows an isometric view of a skeletonized module showing the connection system in a second position where the carrier frame is connected to the module.

The module transportation system 10 in general comprises a support system 12, a carrier frame 14, a module 16, and a carriage 18 (see FIGS. 2 and 3). Further, the module transportation system comprises a module transfer station 22 that is shown in FIG. 1. The module transfer station comprises a railway having railroad tracks 24 and a support system 26 which is now described in detail. The support system 12 comprises support rails 30 that are supported by vertical members 32 (see FIG. 2). The support system in general is adapted to position a carrier frame to move at the proximal speed of a carriage for transferring modules to and from the carriage that are described in detail herein.

Now referring back to FIG. 1, the module transfer station 22 comprises the first and second acceleration zones 34 and 36. In between the first and second accelerations zones 34 and 36 there is a loading zone 38 having a loading platform 40. Further, on/off shoot rails 42 and 44 are provided for attachment and detachment of the carrier frames described herein. Areas 40, 42 and 44 are collectively defined as a loading and unloading region. The module transfer station 22 further comprises first and second exchange 50 and 52. In general, the exchanges are areas where the support rail 30 (see FIG. 2) and the railroad tracks 24 are in closer proximity to facilitate an exchange of a module from the carrier frame 14 to the carriage 18. Of course this procedure is described in more detail below. As shown in FIG. 2, a support system 12 is shown where the support rails 30 are comprised of first and second support members 60 and 62. Further, a central guide rail 64 is adapted to cooperate with the connection system 19 described herein below. The first and second support members 60 and 62 each comprise carrier support surfaces 68 and 70 that are adapted to support the carriage 18 thereunder.

The carrier frame 16 can have on-board motors 85 and 87 (see FIG. 3B) to accelerate it in the acceleration zones adapted to accelerate it to match the speed of the train passing thereunder. A braking system is available to deaccelerate the carrier modules at the unloading zones.

Figure 3C:
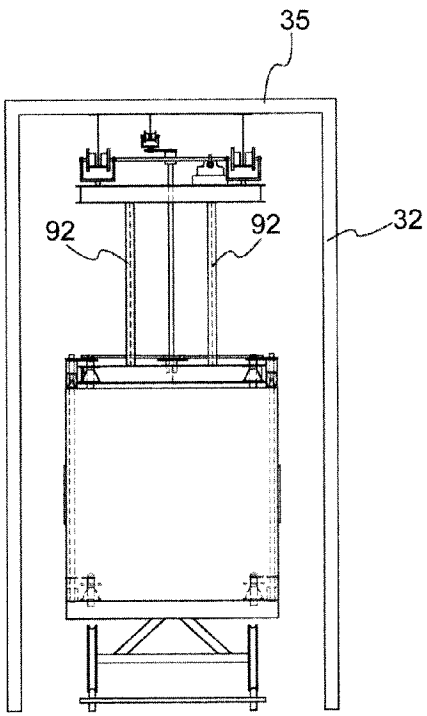
FIGS. 3A-3C show various orthogonal views of the top, side, and rear of a module, carriage, and carrier frame.
Figure 3A:
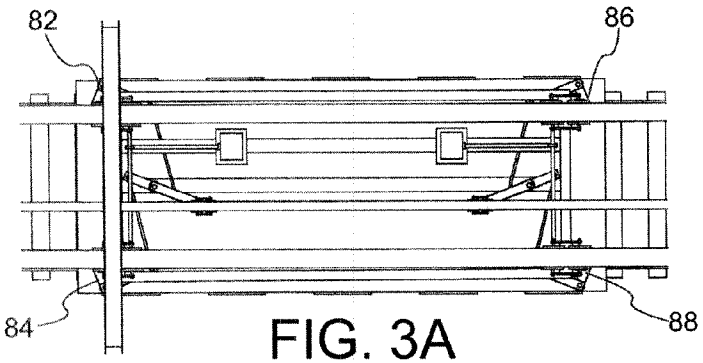

As shown in FIG. 2, the cross-sectional open area 74 defined by the vertical members 32 and the support rails 30 is a cross-sectional footprint that is similar to most tunnels so regular freight can pass therethrough without any structural interference or collision. There will now be a description of the carriage frame 14 with initial reference to FIG. 3B. The carriage frame in general comprises a support unit 80 having, in one form and as shown in FIG. 3A, wheel tracks 82, 84, 86 and 88 that are all adapted to support upon the carriage support surfaces 68 and 70 as shown in FIG. 2. A longitudinally extending member 90 connects the various portions of the wheel tracks together. The vertically extending members 92 are adapted to be positioned in a manner as shown in FIG. 3C so the distance from the upper laterally extending members 33 rested upon the vertical members 32 is at a height to allow freight to pass thereunder.

Now referring to FIG. 2, the carrier frame 14 further comprises, in part, the carrier frame connection system 100. As shown in FIG. 2, the activating member 102 is connected to the lever member 104 which is adapted to engage the central guide rail 64 by the tracking member 106. In general, the orientation of the central guide rail 64 with respect to the first and second support members 60 and 62 dictates the rotation of the activating member 102.

In one form, the activating member 102 of the carrier frame connection system 100 is in a linkage-like communication with the carrier frame lock 110. The carrier frame lock 110 is connected to the lever 112 in a spring-like connection. The connector rod 114 is pivotally connected to the lever 112 and the activating member 102 at location 116. Essentially, the lower horizontal region 118 of the activating member 102, the connector rod 114, and the lever 112 form a four-bar linkage system which is well-known in engineering disciplines.

Figure 4:
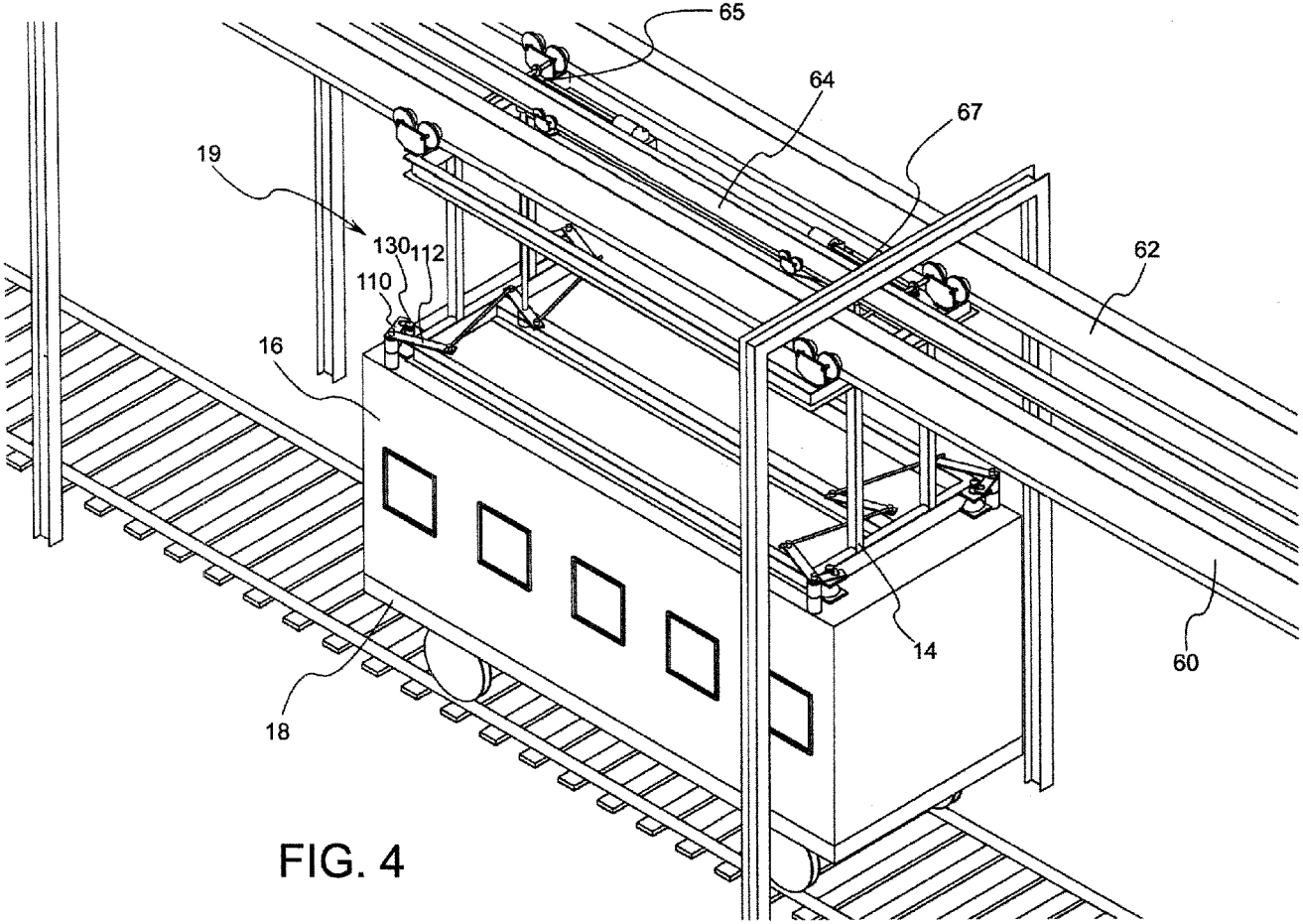
FIG. 4 shows an isometric view of the module where the connection system is in a first position and the module is attached to the carriage.

The support rod 120 extends in the vertical manner within the carriage 18 where the entire embodiment is shown in FIG. 4. Connected to the lower portion of the support rod 120 is a carriage lock 124 that operates in a similar manner as the carrier frame lock 110. The carrier frame lock 110 is attached in a spring-like manner to the lever 112 whereby as the connector rod moves laterally inwardly, the carriage lock 124 will rotate in a direction as indicated by arrow 126 and the carriage connection extension 128 is adapted to receive the notched-out portion 130 of the carriage lock 124. After the carriage connection extension 128 and the carriage lock are in positive engagement, the carrier frame lock 110 will disengage from the carrier frame connection extension 132. Therefore, referring now to FIG. 4, the carrier frame lock 110 is shown disengaged from the carrier frame connection extension 132 whereby (not shown in this figure) the carriage connection extension 128 (see FIG. 2) is in positive engagement with the carriage lever 124.

Referring now to the right-hand portion of FIG. 2, there are a variety of interface connections 140 that are adapted to essentially connect the levers 112 and the torquing action therefrom to the support rods 120. Essentially, the upper portions 150 and lower portions 152 of the interface connection 140 are adapted to engage one another in a temporarily removable manner and be displaced vertically therefrom one another whereby some form of internal surfaces are adapted to transfer torque to the support rod 120.

The base connection 160 is adapted to engage a vertically extending member such as a frustoconical-like member attached to the carriage 18. A frustoconical member (not shown) can engage the lower circular portion of the base connection 160 to properly guide it into a proper orientation for locking of the carriage connection extension 128.

It should be reiterated that the image of FIG. 2 is shown in a skeletonized version whereas the actual embodiment would be shown in FIG. 4 where the module 16 is adapted to house the support rod 120 and carriage lock 124. As shown in FIG. 4, the upper portion of the connection system 19, specifically the carriage frame lock 110, the lever 112, and the connector rod 114, as well as the activating member 102, are all a part of the carrier frame 14 and are moved therewith. These components form module connection portion. It should be noted that various connection systems can be employed for transporting the module 16 from the carriage 18 to the carrier frame 14.

With the foregoing description in mind, reference will now be made to FIG. 1 where various stages of the module transportation system 10 are shown with discussion directed to FIGS. 5-9.

Figure 5:
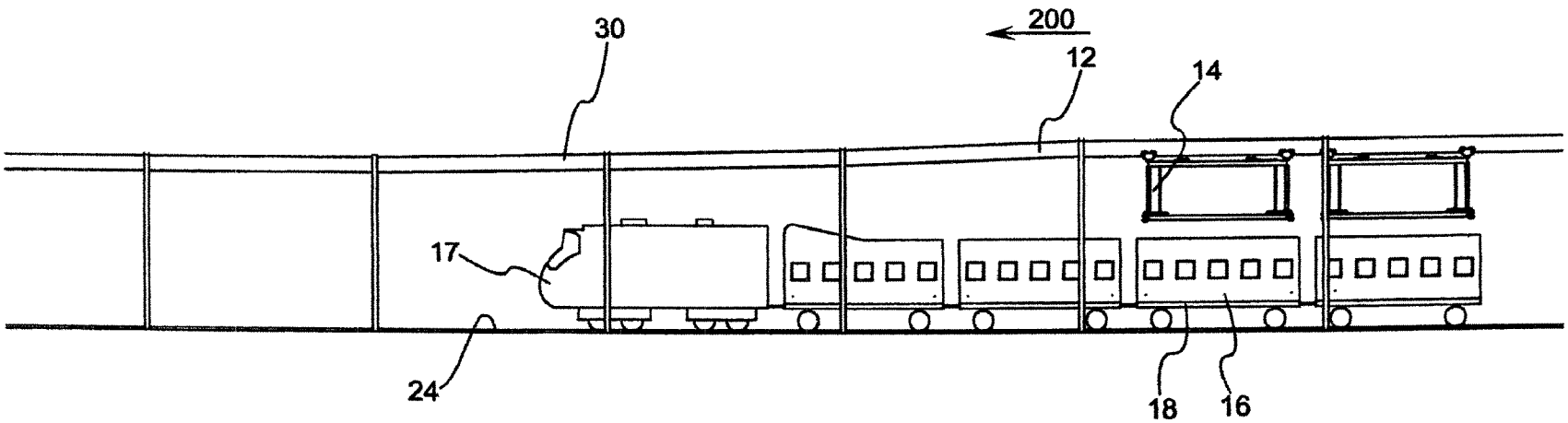
FIG. 5 shows a side view taken at line 5-5 of FIG. 1 where the carrier frame is positioned in an acceleration zone and positioned above the module.

Referring to line 5-5 in FIG. 1, the side view is represented in FIG. 5 where the train 17 is traveling along the track 24 and the support system 12 is positioned thereabove. The carrier frames 14 travel along the support system and are positioned above the modules 16. The support rails 30 of the support system 12 are gradually reduced in elevation with respect to the track 24 whereby as the train travels along the vector indicated at 200, the carrier frame lowers to be in position on top of the module 16.

Figure 11:
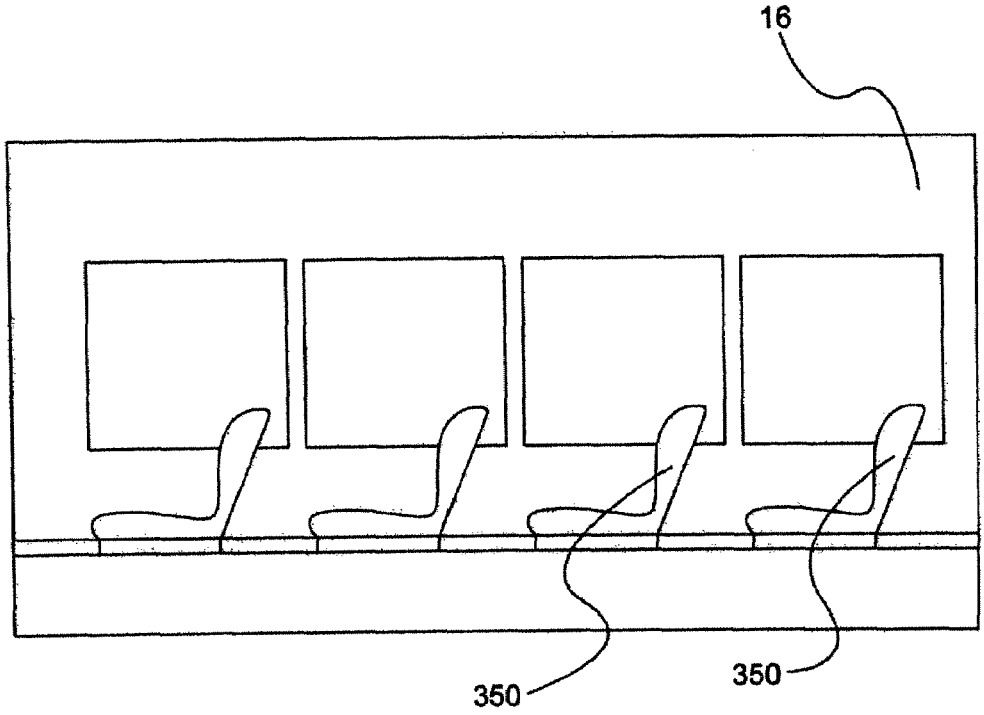
FIG. 11 shows a schematic profile of a module where seats are provided for passengers.
Figure 12:
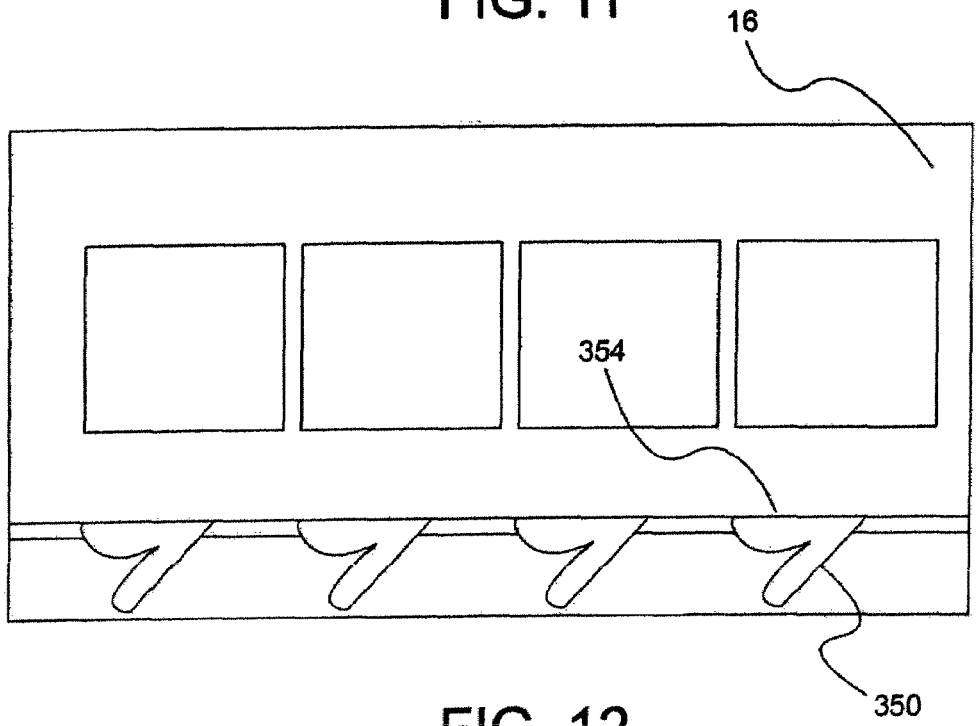
FIG. 12 shows a side cross-sectional schematic profile of a module where the seats are folded or otherwise stored, providing a central region adapted to store and transport light freight.

It should be noted that the carriages in one form, as shown in FIGS. 11 and 12, can have seats which fold down to a tighter gross volume whereby in a storage state, the seats can provide a larger volume for light freight such as mail or other package delivery to be contained therein. This is particularly useful when in one direction, mail is transferred from the first location to a second location and dropped off at the second location. Thereafter, passengers may go from the second location to a third location or back to the first location, whereby the seats would be in their employed position as adapted to support people. This variation is discussed further herein.

Figure 6:
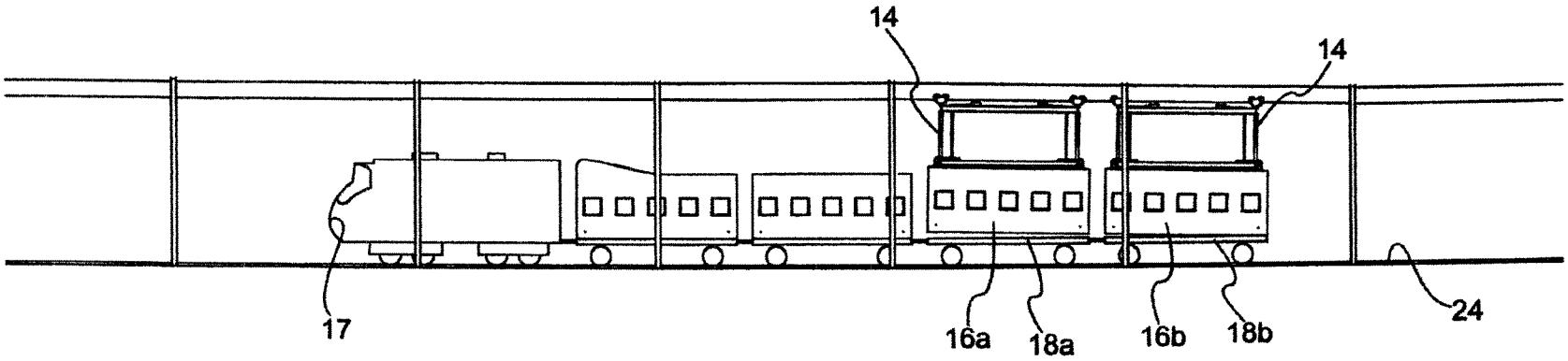
FIG. 6 is taken at line 6-6 of FIG. 1 and shows the carrier frame in a transition state where the module is now attached to the carrier frame and is attached from the carriage.

Now referring to FIG. 6, there is shown an orientation of the train 17 in the exchange zone 52 as shown in FIG. 1, whereby the carrier frames 14 are now being positioned away from the track 24 and the forward module 16*a* is lifting off of the carriage 18. The trailing module 16*b* is also in the early stages of lifting off from the carriage 18*b*. The low point where the carrier frame 14 engages the module 16 is at a rearward location in FIG. 6 in the vicinity of location 202 where the locking procedure of the carrier frame to the module takes place. Referring back to FIG. 2, it should be noted that during the low point 202, the central guide rail 64 repositions in a lateral direction to activate the connection system so the carriage 14 locks on to the module 16 and the carriage lock 124 disengages from the carriage connection extension 128 in an orientation where the connection system is positioned in the first position as shown in FIG. 2, where the carriage connection portion engages the module connection portion. The carriage connection portion is the general area indicated at 210 in FIG. 3*b* and the module connection portion is indicated generally at 212 in FIG. 3*b*.

Figure 7:
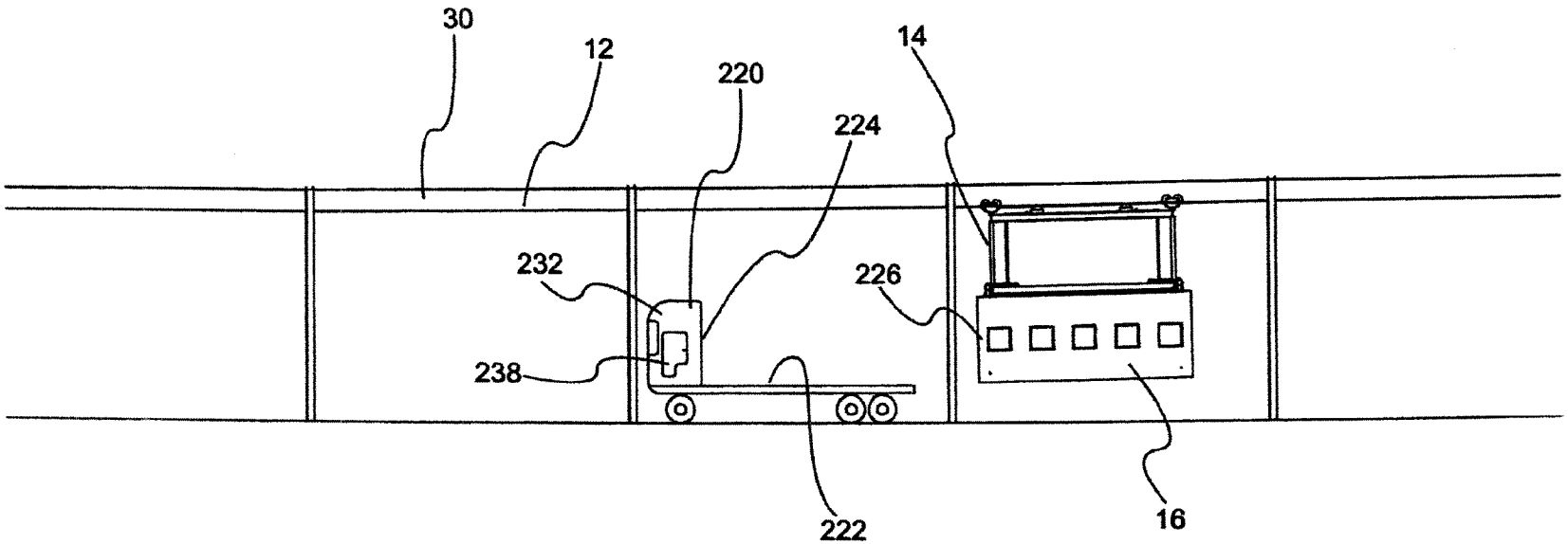
FIG. 7 is taken at line 7-7 of FIG. 1 where the module is transferred from on/off shoot rails to be transported by a transportation vehicle.

Now referring to FIG. 7, there is shown a module 16 hanging from the carrier frame 14 whereby a transportation vehicle 220 for ground transport is shown having a base region 222 that is adapted to have the module 16 mount thereon. The transportation vehicle has an access region 224 whereby an axis panel shown in the forward region at 226 is adapted to interface therewith and allow people or cargo to exit through the passage 230 of the cab region 232. Of course, the module 16 can be transported to and from the transportation vehicle 220 by way of altering the distance from the base region 222 and the support system (more specifically the support rails 30) which controls the height of the carrier frame 14. Further a carrier frame connection portion 213 is provided that connects the module 16 to the carriage 18.

Figure 8:
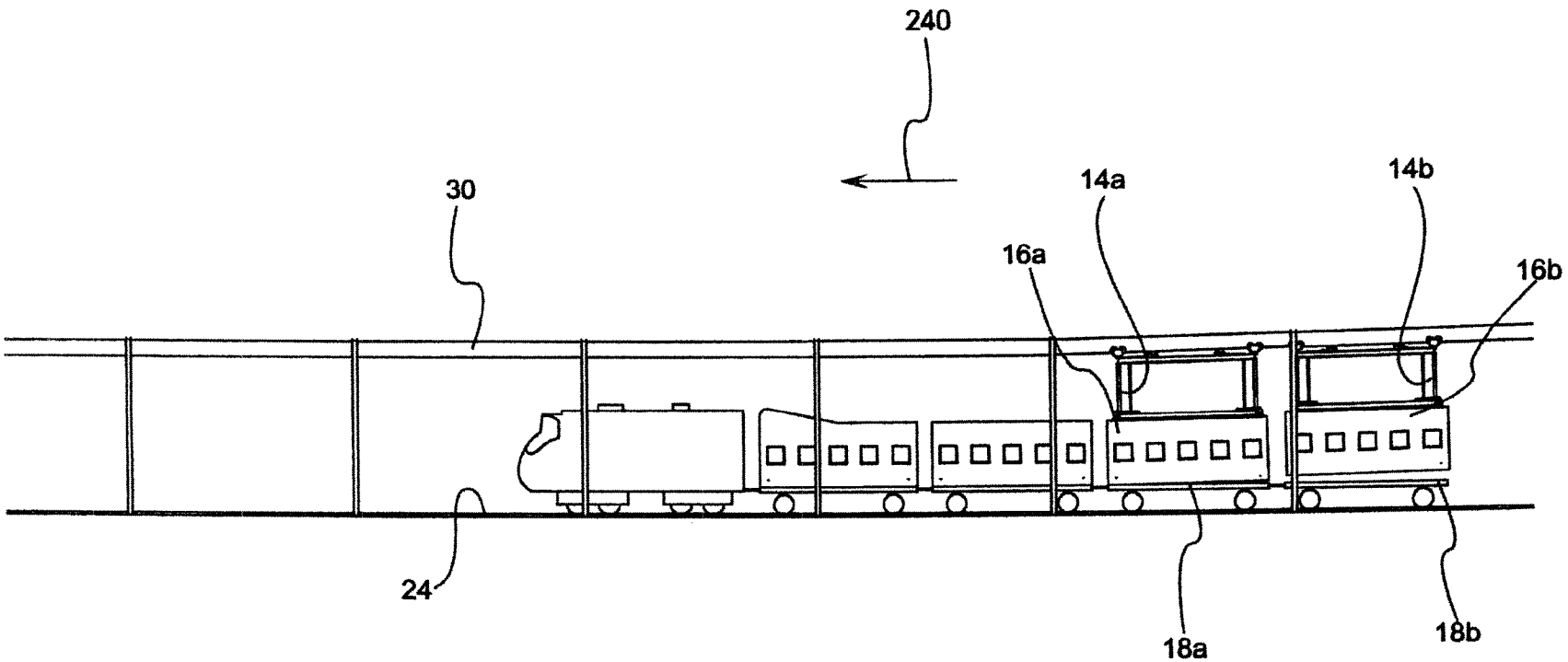
FIG. 8 is taken at line 8-8 whereby the side view shows the modules being transported from the carrier frame to a carriage while the train is in motion.
Figure 9:
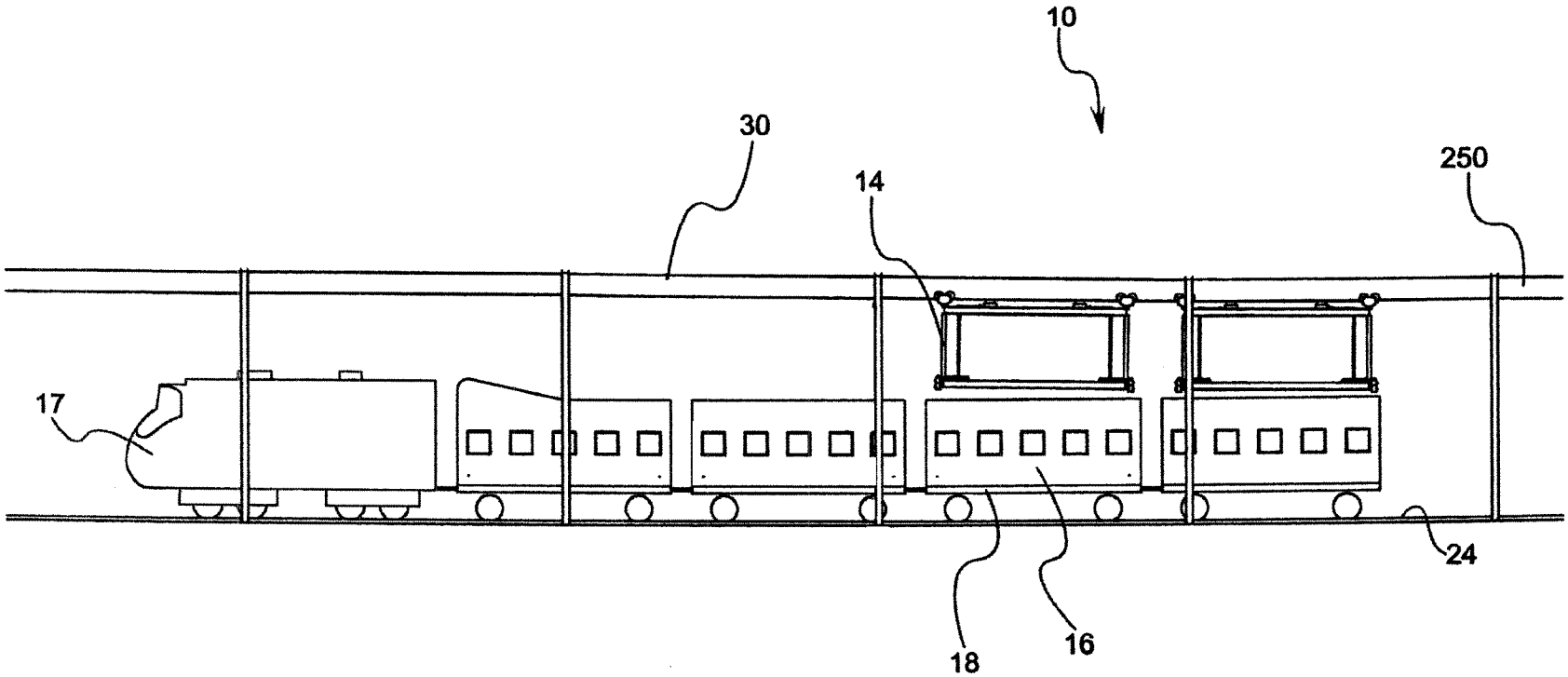
FIG. 9 shows the carrier frames disengaging from the modules where the transfer of the module from the carrier frame to the carriage is complete.

Now referring to FIG. 8, the first exchange zone is shown at the area indicated at 8-8 of FIG. 1, whereby the direction of travel of the train is indicated at 240 and the module 16*a* is being repositioned upon the carriage 18*a* as shown by the relative heights of the trailing module 16*b*. With respect to the carriage 18*b*, it is evident that the support rails 30 are lowering in height with respect to the track 24 at this exchange zone given the direction of the train indicated at 240. FIG. 9 shows the module transportation system 10 where the carrier frames 14 are gradually elevating from the modules 16 whereby at the approximate region indicated at 250 or perhaps a prior location, an exchange occurred whereby in a similar manner as described above, the central guide rail 64 repositioned in a lateral direction in an opposing manner as the previous exchange when removing the modules. Referring now back to FIG. 2, essentially the lever member attached to the central guide rail 64 is repositioned in a lateral direction thereby rotating the activating member 102 in a counterclockwise direction when looking down from the top so that the carriage lock 124 engages the carriage connection extension 128 and then the carrier frame lock 110 disengages from the carrier frame connection extension 132. The final orientation at the low spot 250 as shown in FIG. 9 is shown in FIG. 4 whereby the upper portion of the connection system 19 can be seen and the carrier frame lock 110 is disengaged from the carrier frame extension 132. Therefore, it can be appreciated that the exchange can occur from bearing the height of the support rails 30 with respect to the tracks 24.

Figure 10:
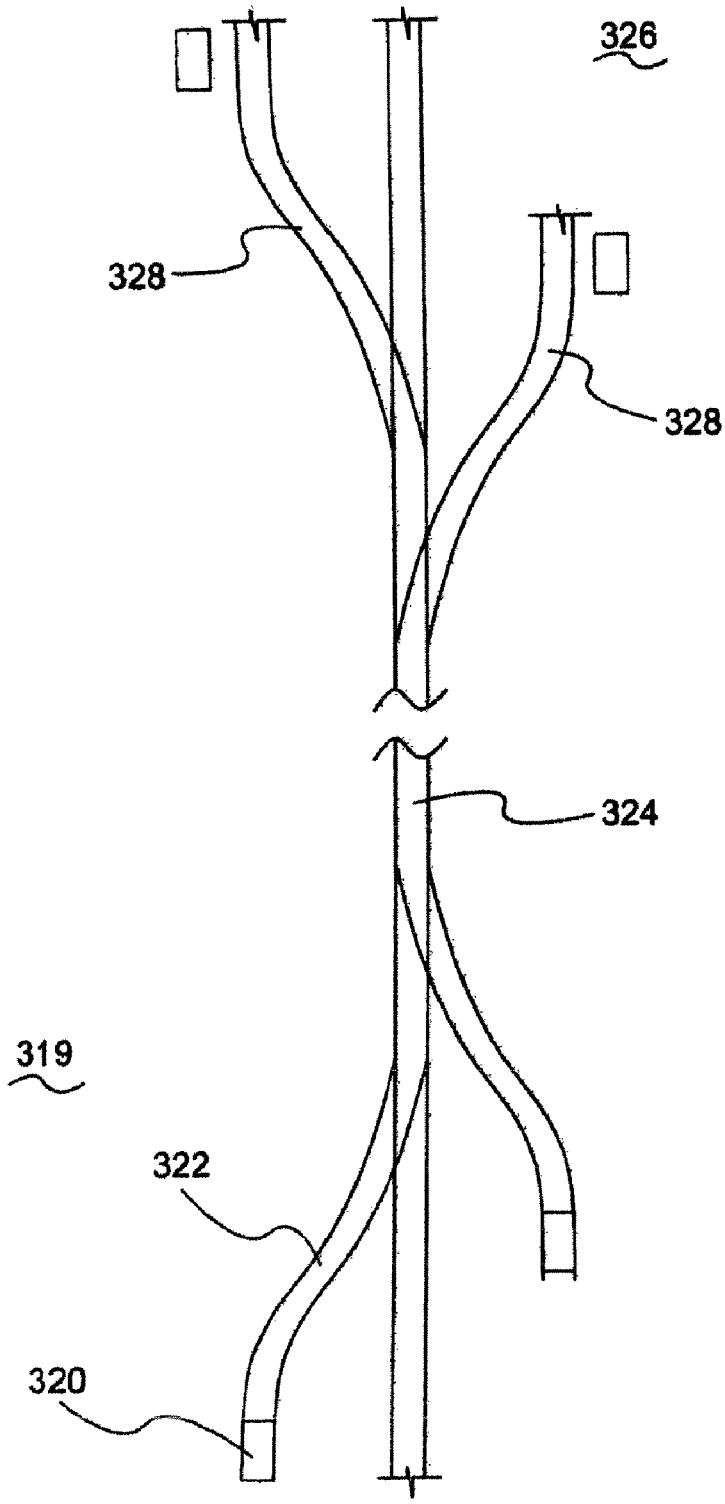
FIG. 10 shows a topography of a system where incoming containers can be positioned on a rail system for transportation to a less congested area for distribution.

As shown in FIG. 10, there is a top view of an area which can represent something like a port 319 where incoming containers indicated at 320 are positioned near rail inlet track sections 322. These railing sections are similar to the railing sections noted above whereby the containers 320 can be attached to a carriage to the track 324 from inlet tracks 322 and transported to a less congested area, referred to as a staging area 326 which would have less congestion by track sections 328 and be more apt to sort the containers and have the public interface with the regards to their contents.

FIG. 11 shows a side cross-sectional view of a schematic module whereby seating 350 is available for passengers. FIG. 12 shows a side cross-sectional view schematic module whereby the seating is now stored in a conventionally known manner where an upper surface 354 is provided for storing and hauling light cargo. For example, light cargo can be hauled from one area to a second area such as from Seattle, Wash. to Vancouver, British Columbia, and while the module is in Vancouver the seating arrangement can be adjusted to allow passengers to be now transported whereby the seating is re-orientated to a version as shown in FIG. 11. The system allows for versatility in hauling light cargo and individuals and various locations with the same module. Further, the modules can be used for situations where a majority of passengers travel in one direction and light cargo travels in the opposite direction from one area to another.

FIG. 11 shows a side cross-sectional view of a schematic module whereby seating 350 is available for passengers. FIG. 12 shows a side cross-sectional view schematic module whereby the seating is now stored in a conventionally known manner where an upper surface 354 is provided for storing and hauling light cargo. For example, light cargo can be hauled from one area to a second area such as from Seattle, Wash. to Vancouver, British Columbia, and while the module is in Vancouver the seating arrangement can be adjusted to allow passengers to be now transported whereby the seating is re-orientated to a version as shown in FIG. 11. The system allows for versatility in hauling light cargo and individuals and various locations with the same module. Further, the modules can be used for situations where a majority of passengers travel in one direction and light cargo travels in the opposite direction from one area to another.

With reference to FIG. 1, it should be noted that the various sections of the topography could include a scanning device shown somewhere upstream at the location indicated at 51, which could passively scan certain containers for various aspects of interest, such as hollow cavity regions or perhaps emitting some form of detectable explosive material whereby authorities could remove the container in a manner as described above without impeding the travel of the train or the flow of goods.

Figure 3B:
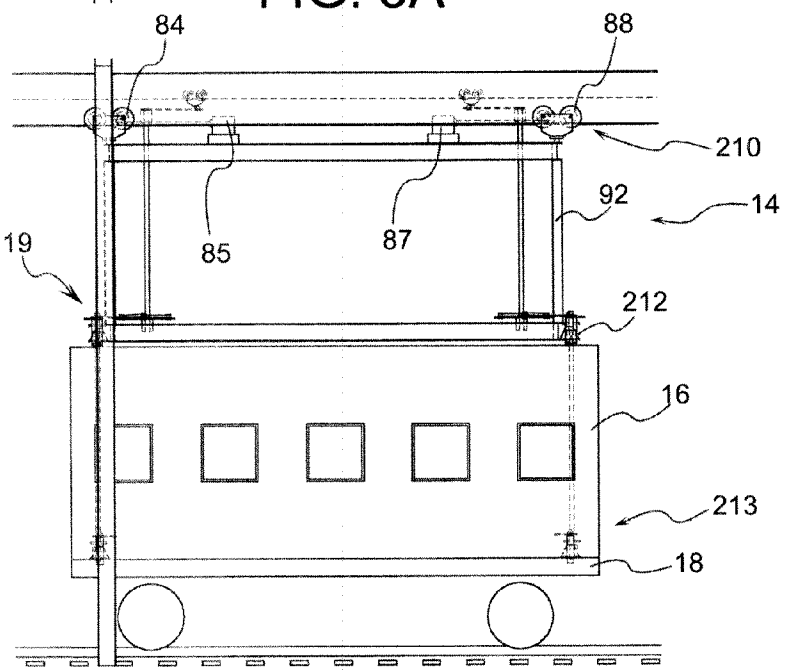

Now referring to FIGS. 3B and 3C, a separate type of module could be employed where the vertical beams 92 are shortened to a higher area whereby two modules which could be containers that are well-known in the art can be stacked upon one another where the module would be a raised central portion having a short member 92 would take up the top module, and the module as shown in FIGS. 3B and 3C could remove the bottom module.

With reference to FIG. 4, in one form, located in the front area 65 and the rearward area 67, are potential locations for first and second power units adapted to accelerate the carrier frame 14. It is generally advantageous to have two redundant drive units in case there is a failure with one; the other would have sufficient power to properly accelerate the carrier 14 to make it operational. The drive units could be powered either locally on battery or through a combustible hydrocarbon such as diesel in some forms, or could be powered by a power line with proper conductive shoes in electrical communication therewith.

A control module is adapted to control the operation of the carrier frame. The control module is adapted to control the acceleration of the carrier frame along the support system in order to accelerate it to correspond to the approximate velocity of the carrier frame, which is a part of the moving train. The control module synchronizes the carrier frame with the carriage during the transition zones so the modules are properly transferred to and from the carriage by way of the carrier frame. Of course, a variety of synchronizing-type mechanisms can be utilized such as optical-type recognition systems, some form of electromagnetic reading of the carrier frame with respect to the carriage, or any other type of positional tracking system.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claim is:

1. A module transportation system adapted to operate over a rail system having train tracks, the module transportation system comprising:

a) a support system comprising support rails supported by vertical members where the support system comprises first and second acceleration and loading zones and an exchange where the vertical members are closer engaged to the train tracks at an exchange zone than at either of the first or second acceleration zones, b) a carrier frame movably attached to the support system and having a module connection portion having a carrier frame connection extension, c) a connection system having a first position and a second position, d) a carriage adapted to travel along the train tracks having a module connection portion, the carriage having a carriage connection extension, e) a module having a carriage connection portion and a carrier frame connection portion and the module being adapted to be positioned on a carriage in a transportation mode and is further adapted and positioned on the carrier frame at the carrier frame connection portion, the module having an internal chamber region;

f) the modules having a plurality of seating members that have a operative position whereby the seating members are oriented to have people sit thereon and a stored position where the seating members are stored whereby increasing internal chamber region of the module for storing cargo therein;

g) a connection system comprising support rod that extends in a substantially vertical direction on the carriage lock connected to the lower portion of the support rod is a carriage lock, a carrier frame lock attached in a spring engagement manner to a lever in the upper portion of the support rod whereby as the connector rod rotates to a locked position, the carriage lock will rotate and lock the carriage connection extension of the carriage, and the carriage connection extension and the carriage lock are in locking engagement, the carrier frame lock is operatively configured to disengage from the carrier frame connection extension of the carriage, whereas the connection system is operatively configured to be positioned in the first position where the carriage connection portion engages the module connection portion of the carriage to fixedly attach thereto and the connection system is further adapted to be orientated in the second position where the carrier connection portion of the module is fixedly attached to the module connection portion of the carrier frame and the carrier frame is adapted to move on the support system at a proximate velocity of the carriage to either engage and offload the module or to unload the module from the carrier frame to the carriage where the carriage does not need to substantially alter its travel velocity.

2. The module transportation system as recited in claim 1 where the support rails and vertical members of the support system define a cross section of a sufficient size to allow carrier freight to pass therethrough.

3. The module transportation system as recited in claim 1 where the support rails change in elevation with respect to the train tracks in the exchange zone and a control module synchronizes the carrier frame to be positioned above the module while the module is moving.

4. The module transportation system as recited in claim 1 where the module is adapted to transport people.

5. The module transportation system as recited in claim 1 where the module comprises frustoconical locking surfaces.

6. The module transportation system as recited in claim 4 where the carrier frame is adapted to position a module at a loading and unloading zone whereby passengers within the module may be transferred to and therefrom and the carrier frame is adapted to accelerate the module back to the train tracks for repositioning on a moving carriage.

7. The module transportation system as recited in claim 4 where the module transportation system provides a module scanner that scans certain containers for various aspects of interest.

* * * * *